United States Patent [19]

Zwiener et al.

[11] Patent Number: 4,607,666

[45] Date of Patent: Aug. 26, 1986

[54] APPARATUS FOR CONTROLLING THE WARP THREAD TENSION BY POSITIONAL DISPLACEMENT OF A BACK REST ON A LOOM

[75] Inventors: Rudolf Zwiener, Arbon, Switzerland; Ernst Mathis, Hohenems, Austria; Theo Thalmann, St. Gallen, Switzerland; Siegfried Röhrich, Götzis, Austria

[73] Assignee: Aktiengesellschaft Adolph Saurer, Arbon, Switzerland

[21] Appl. No.: 786,107

[22] Filed: Oct. 10, 1985

[30] Foreign Application Priority Data

Oct. 16, 1984 [CH] Switzerland ..... 4945/84

[51] Int. Cl.[4] ..... D03D 49/12

[52] U.S. Cl. ..... 139/115

[58] Field of Search ..... 139/114, 115, 109, 110, 139/100

[56] References Cited

U.S. PATENT DOCUMENTS 2,551,920 5/1951 Willis et al. ..... 139/115
2,661,773 12/1953 Kretzschmar ..... 139/114
4,256,147 3/1981 Deborde ..... 139/115
4,480,665 11/1984 Imamura et al. ..... 139/115

FOREIGN PATENT DOCUMENTS 1336771 7/1963 France ..... 139/115

*Primary Examiner*—Henry S. Jaudon
*Attorney, Agent, or Firm*—Werner W. Kleeman

[57] ABSTRACT

The apparatus for controlling the warp thread tension by positional displacement of a back rest on a loom includes a swivelling lever mechanism with a rocking lever which carries the shaft of the back rest and which rocking lever is controlled by a cam plate or disc. The apparatus also includes additional members effecting an additional warp thread tensioning by an additional positional displacement of the back rest during the start-up operation of the loom. The swivelling lever mechanism further includes a connecting element which serves for altering the relative distance between the cam plate or disc and the rocking lever carrying the shaft of the back rest. The relative length of the connecting element is variable by a temporarily operative actuating device. These measures permit a very simple and functionally reliable concept of the additional members of the apparatus.

16 Claims, 3 Drawing Figures

FIG. 2
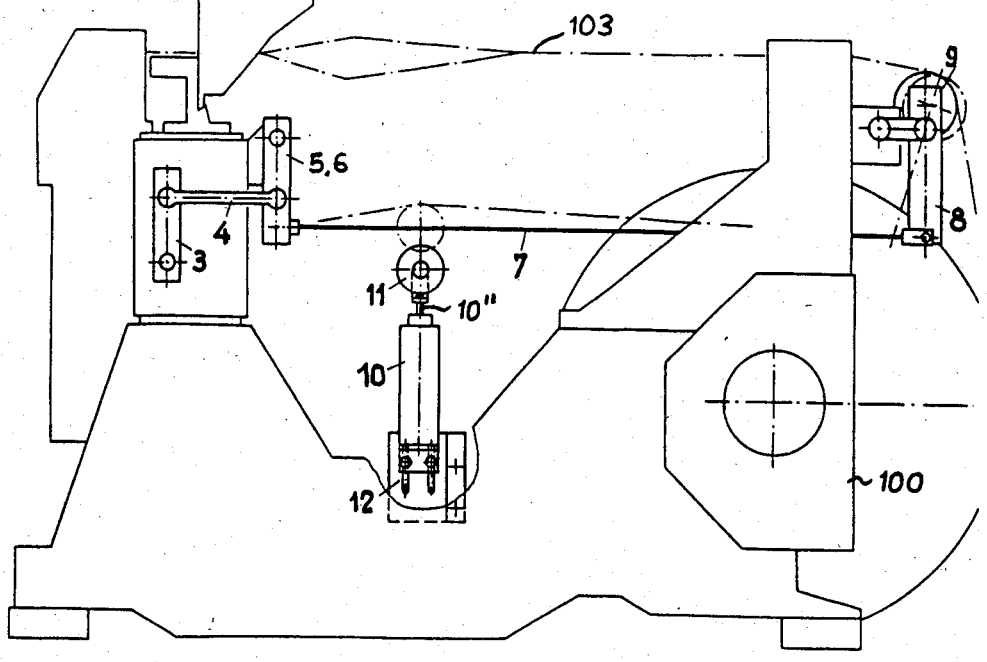
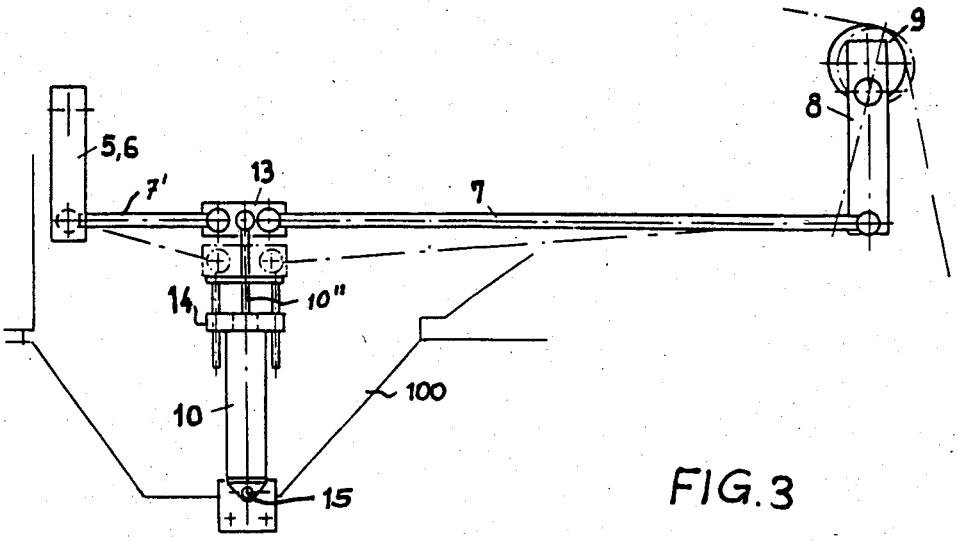
FIG. 3

APPARATUS FOR CONTROLLING THE WARP THREAD TENSION BY POSITIONAL DISPLACEMENT OF A BACK REST ON A LOOM

BACKGROUND OF THE INVENTION

The present invention relates to a new and improved construction of an apparatus for controlling the warp thread tension in a loom or weaving machine containing a back rest.

In its more particular aspects, the present invention specifically relates to a new and improved construction of an apparatus for controlling the wire threads tension by means of positionally displacing the back rest in the loom or weaving machine. The apparatus comprises at least one swivelling lever mechanism which includes at least one rocking lever carrying a shaft of the back rest and which swivelling lever mechanism is controlled by means of at least one cam plate or disc. The apparatus also possesses means effecting an additional warp thread tensioning by means of an additional positional displacement of the back rest during the start-up operation of the loom or weaving machine.

It is a purpose of an apparatus of the abovementioned type to cause, during the start-up operation of the loom or weaving machine, an additional warp thread tension so that the fabric start-up marks or irregularities are prevented which usually appear during the start-up operation of the weaving machines and which visibly reduce the quality of the woven fabric.

In an arrangement known, for example, from German Pat. No. 2,927,533, there is fastened for this purpose on the back rest shaft, an arm adjustable by means of a first swivelling lever. The back rest shaft is carried on rotatably mounted cantilevers, the rotary mounts of which are arranged in levers which are pivotable about a stationary axle. The levers are articulated by means of connecting rods with a further lever which is mounted on a shaft spring-loaded in its rotary direction. In this arrangement, the further lever or swivelling lever of this additional apparatus of the loom or weaving machine is connected with a swivel arm which is rotationally mounted on the spring-loaded shaft. The swivel arm, in turn, is in operative connection with an additional lever fixed to the shaft by means of a hooking apparatus. This hooking apparatus is controllable via an electromagnet such that, during the start-up operation, the back rest shaft is positionally changeable due to the entrainment of the additional lever by the rotationally mounted swivel arm.

Such an arrangement permits an additional positional displacement of the back rest to be superimposed during the start-up operation of the weaving machine upon the tension-controlling displacement of the back rest during normal operation while avoiding the separate auxiliary back rest used at that time in order to prevent the formation of the fabric start-up marks or irregularities. However, this is only realized by means of a technically highly complex apparatus.

SUMMARY OF THE INVENTION

Therefore with the foregoing in mind it is a primary object of the present invention to provide a new and improved construction of an apparatus for controlling the warp thread tension in a loom or weaving machine containing a back rest and which does not exhibit the aforementioned drawbacks and shortcomings of the prior art constructions.

A further important object of the present invention is to provide a new and improved construction of an apparatus of the above-mentioned type which is simpler in construction and thereby less expensive and yet functionally more reliable than heretofore known constructions.

Now in order to implement these and still further objects of the invention which will become more readily apparent as the description proceeds, the apparatus of the present development is manifested by the features that the at least one swivel lever mechanism encompasses at least one connecting element which serves for the variation of the relative distance between the at least one cam plate or disc and the at least one rocking lever which carries the shaft of the back rest. The relative length of the at least one connecting element is changeable by at least one temporarily operative actuating means or device.

These inventive measures result in a very simple and failsafe concept of the additional members of the apparatus in question especially when, in a further development, the actuating means encompass a joint head which interconnects articulated rods and angularly displaces the articulated rods from their lengthwise extension for the purpose of shortening their common relative length.

In this apparatus, the connecting element may constitute a rope-like element or cable which can be deflected out of its extension or normal lengthwise direction of extent wherefore the actuating means encompass a rope or cable roll or pulley by means of which the rope-like element or cable can be deflected in any desired plane for shortening the same without thereby obstructing the machine controlled swivelling movement at the back rest. In general, however, the deflection will be carried out upwardly or downwardly in a vertical plane.

The connection element can also be formed by an articulated rod arrangement which is deflectable out of its lengthwise extension. In this case, the actuating means advantageously may encompass a joint head interconnecting the articulated rods.

For actuating the rope or cable roll or the joint head, use can be made in a simple and functionally reliable manner of a pneumatic or hydraulic piston-cylinder system or a plunger-type armature system. The operative piston of the piston-cylinder system or the plunger of the operative plunger-type armature system carries the rope or cable roll or joint head. Preferably, the operating stroke of the piston is adjustable.

In both cases, it is useful if the actuating means are controllable by means of a machine starting signal and if the actuating means can be reset by means of a time signal generator or by means of a position encoder dependent upon a predetermined machine angle of the main shaft of the weaving machine.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein:

FIG. 2 is a schematic side view of a first practical exemplary embodiment of the inventive apparatus shown in FIG. 1; and FIG. 3 is a schematic side view of a second practical exemplary embodiment of the apparatus shown in FIG. 1.

DETAILED DESCRIPTION OF THE PREFERRED EMBODIMENTS

Figure 1:
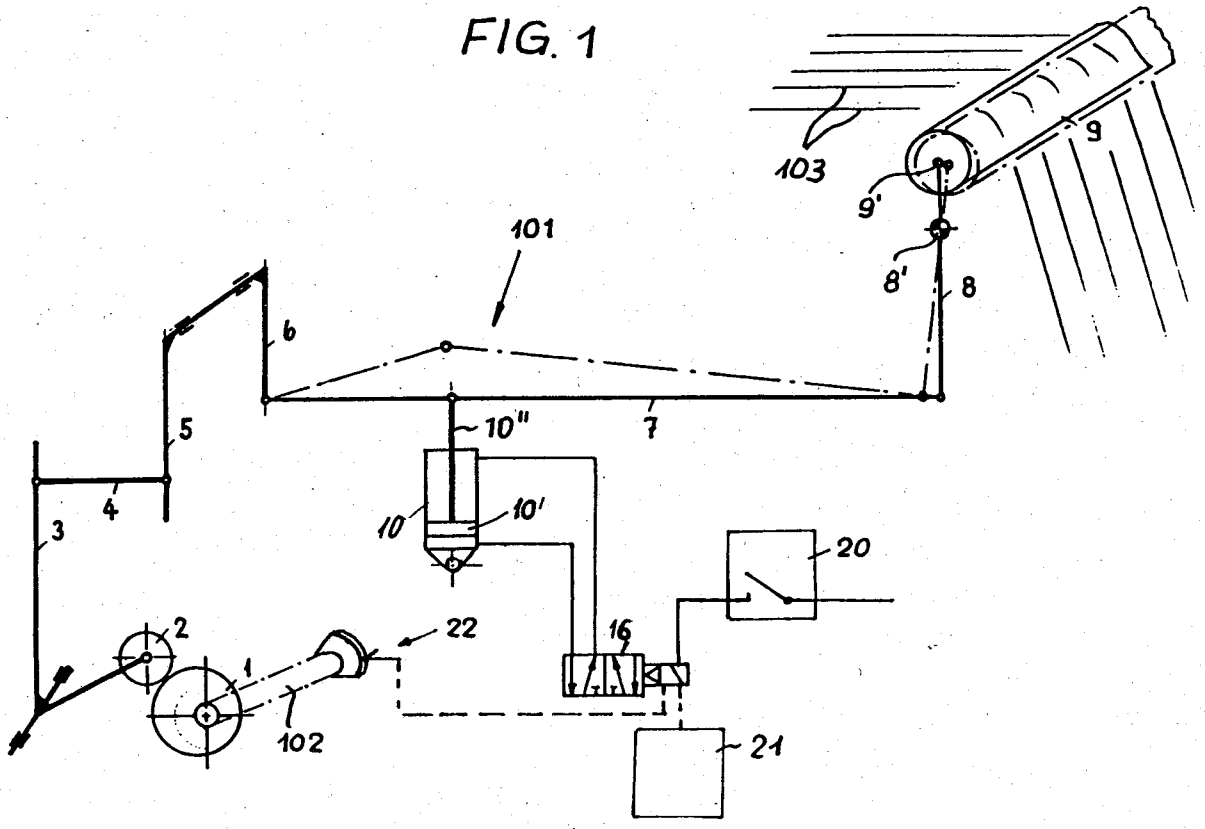
FIG. 1 is a schematic illustration of the functional principle of the inventive apparatus for controlling the warp thread tension by positionally displacing a back rest in a loom or weaving machine.

Describing now the drawings it is to be understood that to simplify the showing thereof, only enough of the structure of the apparatus for controlling the warp thread tension has been illustrated therein as is needed to enable one skilled in the art to readily understand the underlying principles and concepts of this invention. Turning now specifically to FIG. 1 of the drawings, the apparatus depicted by way of example and not limitation therein will be seen to comprise an apparatus for controlling the warp thread tension by positionally displacing a back rest 9 of a loom or weaving machine 100 which is merely schematically indicated in FIG. 2. The apparatus encompasses in known manner a swivelling mechanism 101; generally one such mechanism is provided on each of the two sides of the weaving machine. Each swivelling mechanism 101 ends in a rocking lever 8 which carries a shaft 9′ of the back rest 9. The swivelling mechanisms 101 are controlled by at least one cam plate or disc 1 which may be arranged, for example, on a main shaft 102 of the loom or weaving machine 100.

During the continuous run of the loom or weaving machine 100, the cam plate or disc 1 enables the control of the pivoting movement of the rocking lever 8 about its fulcrum 8′ which has the effect of regulating the tension of warp threads 103 which partly encircle the back rest 9.

For this purpose, each swivelling lever mechanism 101 includes, on a control side and in addition to the aforementioned rocking lever 8, a lever arrangement comprising transmitting elements 3 to 6 as well as a control roll or wheel 2 which cooperates with the cam plate or disc 1.

In order to enable additional warp thread tensioning by means of an additional positional displacement of the back rest 9 during the start-up operation of the loom or weaving machine 100 there is provided in accordance with the invention, a deflectable connecting element 7 between the abovementioned rocking lever 8 and the cam plate or disc 1 or transmitting elements 3 to 6 on the control side of the swivelling lever mechanism 101. This connecting element 7 permits its relative length or the relative distance between cam plate or disc 1 and the rocking lever 8 to be temporarily shortened in order to thereby effect the additional positional displacement of the back rest 9 as shown in FIG. 1 by dash-dotted lines. For this purpose, the temporarily operative actuating means engage the connecting element 7. The actuating means may form a pneumatic or hydraulic piston-cylinder system 10 and the operative piston 10′ thereof is in operative connection by means of its piston rod 10″ with the connecting element 7. It is useful if the operating stroke of the piston 10′ is adjustable.

The control of this piston-cylinder system 10 or its switch valve 16 is advantageously effected by means of a machine starting signal generated by a machine-start signal transmitter 20. The actuating means 10 can be reset by means of a reset signal transmitter which may constitute, for example, a time signal generator 21 or a position encoder 22 dependent upon a predetermined rotational angle of the main shaft 102 of the loom or weaving machine 100, as is shown by dashed lines in FIG. 1.

It should be self evident that also other actuating means are feasible for the connecting elements, for example, an electromagnetic plunger-type armature system or the like. In such plunger-type armature system, the armature constitutes an operative member which acts upon the connecting element 7 constituting, for example, a rope-like connecting element or an articulated rod arrangement of the type described hereinafter with reference to FIGS. 2 and 3. Preferably, the armature performs an adjustable, variable operating stroke.

In accordance with a first practical exemplary embodiment of the inventive apparatus shown in FIG. 2, the connecting element 7 may constitute a rope-like connecting element or cable which is upwardly deflectable out of its predetermined extension as shown in this FIG. 2 by the dash-dotted lines. For such deflection, the piston rod 10″ of the operative piston 10′ of the piston-cylinder system 10 carries at its free end a rope or cable roll or pulley 11 which even on deflection of the rope-like connecting element 7 ensures an unobstructed transmission of the pivoting movement toward the back rest 9 which movement is triggered by the cam plate or disc 1 not visible in such FIG. 2. A stroke adjustment in this apparatus can be achieved by means of an adjustment plate 12.

In a second exemplary embodiment of the inventive apparatus illustrated in FIG. 3, the connecting element 7 is constituted by an articulated rod arrangement 7 and 7′, wherein the inner ends of the articulated rods 7 and 7′ are articulated to a joint head 13 which, in turn, is tiltably seated upon the free end of the piston rod 10″ of the relabled piston cylinder system 10. And adjustable stop plate 14 serves as an operating stroke limiter for the operating piston in this apparatus. According to the dash-dotted lines, in this case, the articulated rod arrangement 7 and 7′ is downwardly deflected for shortening the relative length of the articulated rod arrangement 7 and 7′. The actuating means 10 thus deflect the articulated rod arrangement 7 and 7′ out of its predetermined lengthwise extension.

The piston-cylinder system 10 is supported with its lower end at the frame of the weaving machine 100 by means of a pivot axle 15 in order to ensure within this arrangement the swivelling movement of the system in dependence upon the here not shown cam plate or disc 1.

From the foregoing description, there are thus evident additional means or members in a loom or weaving machine which permit in the simplest and functionally most reliable manner, the superposition of an additional positional displacement during the starting operation upon the tension regulating movement of the back rest during normal operation of the loom or weaving machine in order to thereby prevent the appearance of the so-called fabric start-up marks or irregularities.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. An apparatus for controlling the warp thread tension in a weaving machine containing a back rest, said apparatus comprising:

at least one cam disc operatively connected with said weaving machine;

at least one swivelling lever mechanism controlled by said at least one cam disc;

said back rest containing a shaft;

said at least one swivelling lever mechanism encompassing at least one rocking lever carrying said shaft of said back rest;

said at least one swivelling lever mechanism and said at least one cam disc cooperating in order to positionally displace said back rest for warp thread tensioning during normal operation of said weaving machine;

means for causing an additional positional displacement of said back rest in order to generate an additional warp thread tensioning during the start-up operation of said weaving machine;

said means for generating said additional positional displacement of said back rest including at least one actuating means;

said at least one swivelling lever mechanism further encompassing a connecting element which serves for adjusting a relative distance between said at least one cam disc and said at least one rocking lever which carries said shaft of said back rest;

said at least one connecting element having a variable relative length determining said relative distance between said at least one cam disc and said at least one rocking lever which carries said shaft of said back rest; and said at least one actuating means being temporarily operable in order to vary said relative length of said at least one connecting element.

2. The apparatus as defined in claim 1, wherein:

said at least one connecting element constitutes at least one rope-like connecting element having a predetermined lengthwise extension; and said at least one rope-like connecting element being deflectable out of said predetermined lengthwise extension.

3. The apparatus as defined in claim 2, wherein:

said at least one actuating means encompassing at least one rope pulley; and said at least one rope pulley acting upon said at least one rope-like connecting element.

4. The apparatus as defined in claim 3, wherein:

said at least one actuating means are constituted by at least one fluid-operated piston-cylinder system; and said at least one fluid-operated piston-cylinder system containing at least one operative piston carrying said at least one rope pulley.

5. The apparatus as defined in claim 4, wherein:

said at least one operative piston performing an operating stroke; and said operating stroke of said at least one operative piston being adjustable.

6. The apparatus as defined in claim 3, wherein:

said at least one actuating means are constituted by at least one plunger-type armature system; and said at least one plunger-type armature system containing at least one operative armature carrying said at least one rope pulley.

7. The apparatus as defined in claim 6, wherein:

said at least one operative armature performing an operating stroke; and said operating stroke of said at least one operative armature being adjustable.

8. The apparatus as defined in claim 1, wherein:

said at least one connecting element constitutes at least one articulated rod arrangement having a predetermined lengthwise extension; and said at least one articulated rod arrangement being deflectable out of said predetermined lengthwise extension.

9. The apparatus as defined in claim 8, wherein:

said at least one actuating means encompasses at least one joint head interconnecting articulated rods of said at least one articulated rod arrangement.

10. The apparatus as defined in claim 9, wherein:

said at least one actuating means are constituted by at least one fluid-operated piston-cylinder system; and said at least one fluid-operated piston-cylinder system containing at least one operative piston carrying said at least one joint head.

11. The apparatus as defined in claim 10, wherein:

said at least one operative piston performing an operating stroke; and said operating stroke of said at least one operative piston being adjustable.

12. The apparatus as defined in claim 9, wherein:

said at least one actuating means are constituted by at least one plunger-type armature system; and said at least one plunger-type armature system containing at least one operative armature carrying said at least one joint head.

13. The apparatus as defined in claim 12, wherein:

said at least one operative armature performing an operating stroke; and said operating stroke of said at least one operative armature being adjustable.

14. The apparatus as defined in claim 1, further including:

a machine-start signal transmitter;

said machine-start signal transmitter controlling said at least one actuating means such as to assume an operative position;

a reset signal transmitter; and said reset signal transmitter generating a reset signal for resetting said adjusting means into an inoperative position from said operative position thereof.

15. The apparatus as defined in claim 14, wherein:

said reset signal transmitter constitutes a time signal transmitter.

16. The apparatus as defined in claim 14, further including:

a weaving machine main shaft moving through a predetermined machine angle during operation of said weaving machine;

said reset signal transmitter constituting a position encoder, and said position encoder responding to said predetermined machine angle.

* * * * *

UNITED STATES PATENT AND TRADEMARK OFFICE

CERTIFICATE OF CORRECTION

PATENT NO. : 4,607,666

DATED : August 26, 1986

INVENTOR(S) : RUDOLF ZWIENER et al

It is certified that error appears in the above—identified patent and that said Letters Patent is hereby corrected as shown below:

Column 1, line 14, please delete "wire threads" and insert --warp thread--

Column 4, line 41, please delete "relabled" and insert --related--

Signed and Sealed this

Twenty-third Day of December, 1986

*Attest:*

DONALD J. QUIGG

*Attesting Officer* *Commissioner of Patents and Trademarks*